United States Patent [19]

Goldfarb

[11] 4,336,935

[45] Jun. 29, 1982

[54] MUSICAL GAME APPARATUS

[76] Inventor: Adolph E. Goldfarb, 4614 Monarca Dr., Tarzana, Calif. 91356

[21] Appl. No.: 109,091

[22] Filed: Jan. 2, 1980

[51] Int. Cl.[3] ..... A63F 9/00

[52] U.S. Cl. ..... 273/1 E; 84/1.01

[58] Field of Search ..... 273/1 E; 434/339; 84/1.01, 1.03

[56] References Cited

U.S. PATENT DOCUMENTS

| | | | |
|---|---|---|---|
| 3,438,628 | 4/1969 | Becker et al. | 273/1 E |
| 3,795,989 | 3/1974 | Greenberg et al. | 434/339 |
| 3,800,437 | 4/1974 | Lamberson | 434/339 |
| 4,207,087 | 6/1980 | Morrison et al. | 273/1 E |

*Primary Examiner*—William H. Grieb

*Attorney, Agent, or Firm*—Romney, Golant, Martin, Disner & Ashen

[57] ABSTRACT

Disclosed is an electronic game apparatus that in its preferred embodiment may be used either to play a game of musical concentration or else as a musical instrument. The apparatus is provided with an on-off switch, four mode buttons and a 5 by 5 keyboard having 24 active designator buttons. When the apparatus is placed in the musical instrument mode, each keyboard button is associated with a different musical note in the chromatic scale; thus the instrument is capable of playing two full chromatic octaves. When the apparatus is operated in one of its game modes, (some of which may be "easy"; other "difficult") a number of different tunes, each having an average length of approximately ten notes, are each assigned by the apparatus at the commencement of a game to a pair of designator buttons of the keyboard in a random or apparently random manner unknown to the players at the game's commencement. For each turn of play, a player depresses a first designator button, hears at least a portion of the tune assigned to that button, and then attempts to match it with the other button also assigned to that same tune by depressing a second designator button.

12 Claims, 5 Drawing Figures

MUSICAL GAME APPARATUS

FIELD OF THE INVENTION

The present invention pertains generally to game and amusement apparatus and more particularly to electronic apparatus for the playing of a musical concentration game.

BACKGROUND OF THE INVENTION

A. The Prior Art

Electronic apparatus are well known which have a keyboard comprising a plurality of electrical contacts, electronic circuitry for generating electrical signals of a musical nature whose frequency content is determined by which key or keys of the keyboard have been depressed and the associated contacts closed, and a loudspeaker or other transducer for converting such musical electrical signals into audible musical sounds.

Additionally, game and amusement electronic apparatus are well known in which different tunes are preprogrammed and stored within a read-only memory associated with a micro-processor or other computational element controlling the operation of the apparatus, so that in response to certain operational sequences, selected ones of said tunes may be generated electronically and made audible to the player.

However, it is not believed that any prior art electronic musical apparatus was adapted for the playing of a game of musical concentration, such as attempting to match pairs of designators that have been both assigned to the same tune in a manner unknown to the players at the game's commencement.

B. Summary of the Invention

Accordingly, it is an overall object of the present invention to provide electronic apparatus adapted for playing a game of musical concentration.

It is a more specific object of the present invention to provide such an apparatus wherein the game entails matching to each other a pair of buttons on a keyboard (or other designating means) which have been associated with the same musical tune at the game's commencement in a predetermined but more or less random fashion unknown to the players.

It is another object of the present invention to provide electronic musical apparatus which will enhance the musical skill of a player by encouraging him to learn how to distinguish different musical sequences from one another and optionally by giving the player the opportunity to imitate the pre-programmed tunes (or any other sequences of musical notes) by playing them "by ear" one note at a time.

Briefly, the invention which satisfies these and such other objects as will become more apparent from the study of the detailed description of a preferred embodiment which follows, is an electronic amusement apparatus having a keyboard with a plurality of buttons which may be selected by the player one at a time (or other designator means), an electronic music synthesizer/-transducer for generating the musical notes associated with various pre-programmed tunes and making them audible to the player, and an electronic game controller which associates at the commencement of a game some or all of the tunes with pairs of said buttons selected more or less at random, and which for each turn of play causes said musical synthesizer/transducer to play at least a portion of the tune associated with a first selected button and then, depending upon whether the second selected button is from another button pair or is paired with the first button, either causes at least a portion of the tune associated with the second button to be heard or else a signal output signifying the successful matching of a pair of buttons associated with the same tune.

As an option, the apparatus may be provided with mode selector buttons affecting the level of difficulty of the game play; furthermore, one or more of the keyboard buttons may be randomly assigned a "wild" status, and will be treated as matching any not yet matched button.

The preferred embodiment incorporates the optional capability of allowing the player to play tunes "by ear" one note at a time.

BRIEF DESCRIPTION OF THE DRAWINGS

For a better understanding of the present invention, reference is made to the following detailed description and to the appended drawings in which.

DETAILED DESCRIPTION OF A PREFERRED EMBODIMENT

Figure 1:
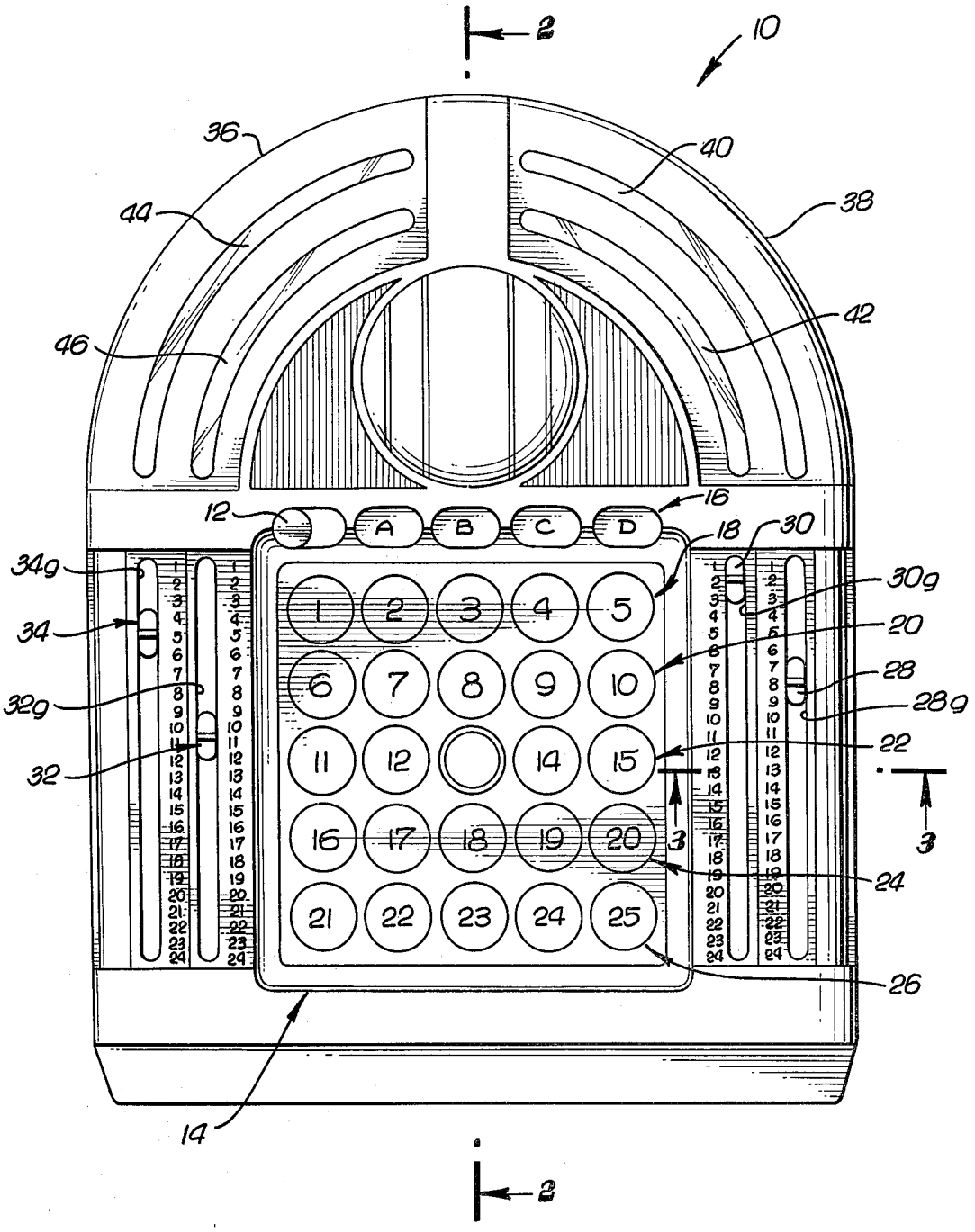
FIG. 1 depicts a preferred embodiment of the apparatus of the present invention as seen from its front (keyboard side).

Referring now to FIG. 1, it may be seen that the apparatus of the present invention may advantageously be contained within a relatively small and portable housing (designated generally by the reference numeral 10) containing an on-off switch 12 at the upper left portion of a keyboard contact array arranged generally in a 6 by 5 matrix (designated generally by the reference numeral 14) which in the embodiment illustrated has a first row 16 comprising four mode keys designated A, B, C, and D; a second row 18 containing five key buttons designated with the numerical indicia 1, 2, 3, 4, and 5; a third row 20 containing five key buttons bearing the numerical designations 6, 7, 8, 9, and 10 respectively; a fourth row 22 containing four key buttons bearing the designations 11, 12, 14, and 15 (in the illustrated embodiment, the number 13 is not associated with any active key); a fifth row 24 and containing five key buttons bearing respectively the numerical designations 16, 17, 18, 19, and 20; and a sixth row 26 containing five key buttons bearing the designations 21, 22, 23, 24, and 25 respectively.

It should be understood that, although in the case of the present embodiment the various mode key buttons contained in the first row 16 bear alphabetic indicia and the various tune select key buttons contained in second through sixth rows 18, 20, 22, 24 and 26 bear numerical indicia, other similar means of designating the various keys may be employed or the physical keys themselves may lack particular designations, their location within the keyboard array serving to designate their function to the player. Furthermore, it should be apparent to those skilled in the art that instead of a matrix type keyboard such as is illustrated with each key in the matrix performing a separate and distinct function, it would be possible to employ an input scheme wherein a single function could be designated by the pressing of several keys in sequence, as for example, by the use of a conventional 10 key keyboard in which, instead of pressing a button located at a first position, the player would input the digit "0" and then "1", and in which, instead of pressing a button located at a 25th position, the player would press the "2" key followed by the "5" key.

Also visible in FIG. 1 are four manually slideable scoring accumulator knobs designated by the reference numerals 28, 30, 32 and 34, which slide in their respective grooves designated by the reference numerals 28*g*, 30*g*, 32*g*, and 34*g*, each provided with scoring indicial 1–24 as shown.

The manner of construction of these scoring accumulator buttons and associated grooves is better visible in FIG. 3 and will be discussed in more detail hereinafter in connection with that Figure.

At this point it may be remarked that the housing 10 as shown in FIG. 1 is designed in the form of an antique jukebox. This is a particularly apt theme, not only because the apparatus can also function as a musical instrument, but also on account of the fact that pressing of the various buttons located on second through sixth rows 18, 20, 22 etc. causes pre-programmed tunes to be automatically synthesized and made audible to the player, much as tunes are selected for play in a real jukebox.

In connection with this jukebox theme, it may be seen that the upper portion of housing 10 assumes a semi-circular shape featuring two illumiatable quadrants designated generally by the reference numerals 36 and 38 respectively, each of which comprises a lamp cover having a generally textured, translucent surface but not transparent except within the two arcs indicated by the reference numerals 40 and 42 (for the right hand quadrant 38) and by the referenced numerals 44 and 46 (for the left hand quadrant 36). The remaining portions of the housing 10 visible in FIG. 1 are opaque to light, at least in the embodiment illustrated.

Figure 2:
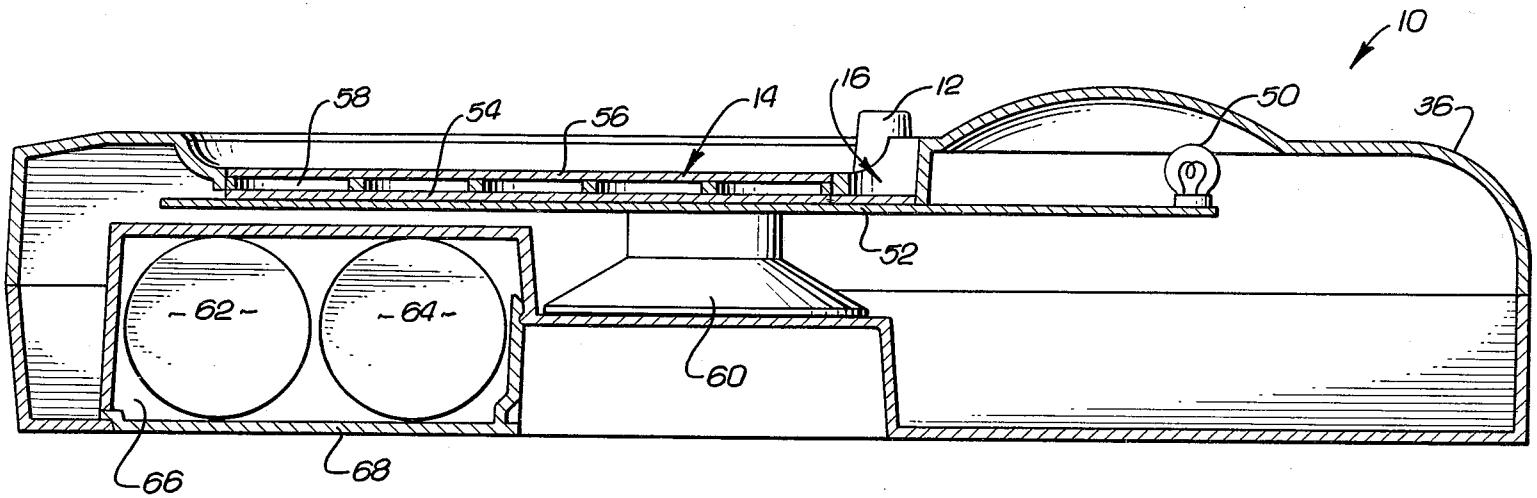
FIG. 2 is a cross-sectional view of the apparatus of FIG. 1 taken along the center line designated 2—2, and shows in particular where the various components are located within the interior of the apparatus.

Referring now to FIG. 2, it may be seen that contained within said housing 10 beneath upper left and right quadrants 36 and 38 is a first lamp 50 (and a second lamp 50*a* not visible) which when illuminated successively on and off produces a visual flickering effect through the transparent and translucent portions of said quadrant lamp covers, again capturing the spirit of an old time jukebox. Lamp 50 is mounted at one end of a printed circuit board 52 whose other end is more or less covered by the keyboard matrix array 14, which preferably comprises a first contact layer 54 spaced below a second contact layer 56 by means of a spacing layer 58 which is open in the region beneath the various active keybuttons of keyboard 14. Located below circuit board 52 is a loudspeaker 60 which, for ease of assembly, may be both physically and electrically connected to the printed circuit board 52, but which also obviously could be located remote from the circuit board and connected electrically thereto by means of a suitable wiring harness. Finally, from FIG. 2, it may be seen that four dry cell batteries 62 and 64 (and 63 and 65, not visible) are located in a battery compartment 66 provided with an access cover 68 underneath the housing. By employing conventional flashlight batteries, the apparatus contemplated herein may be made completely portable and independent of any requirement of connection to an external power source, and at the same time can be made quite safe—even if the apparatus is subjected to use by small children in a manner not contemplated by its proper operation—since only low voltages are present.

Figure 3:
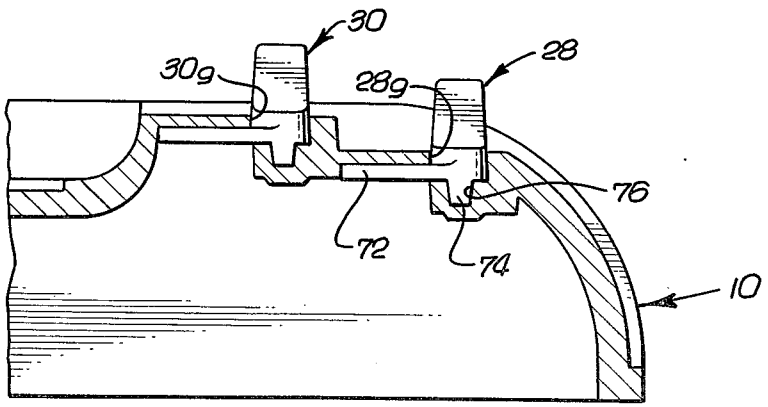
FIG. 3 is a cross-sectional view taken along the section line designated 3—3 in FIG. 1, and shows a detail of the mechanical score accumulators provided as part of the apparatus.

Referring now to FIG. 3 showing in detail the scoring accumulator knobs 28, etc. in the grooves 28*g*, etc., it may be seen that each such accumulator button comprises a protruding upper portion adapted to be held between the thumb and forefinger of a player, a planar bearing portion 72 protruding from one side and sliding against a planar bearing surface provided on the inside of keybord 14, and a locating lug 74 that slides within a corresponding groove 76 integrally molded in the main body of housing 10.

Although other more complex forms of construction of such a sliding score accumulator would doubtless be possible, the configuration illustrated has the advantage of being easily fabricated during the injection molding of the housing body 10 and the knobs 28, etc. with no subsequent machining steps being required, and of being conveniently snapped together and permanently retained without the use of any separate springs or fasteners.

Figure 4:
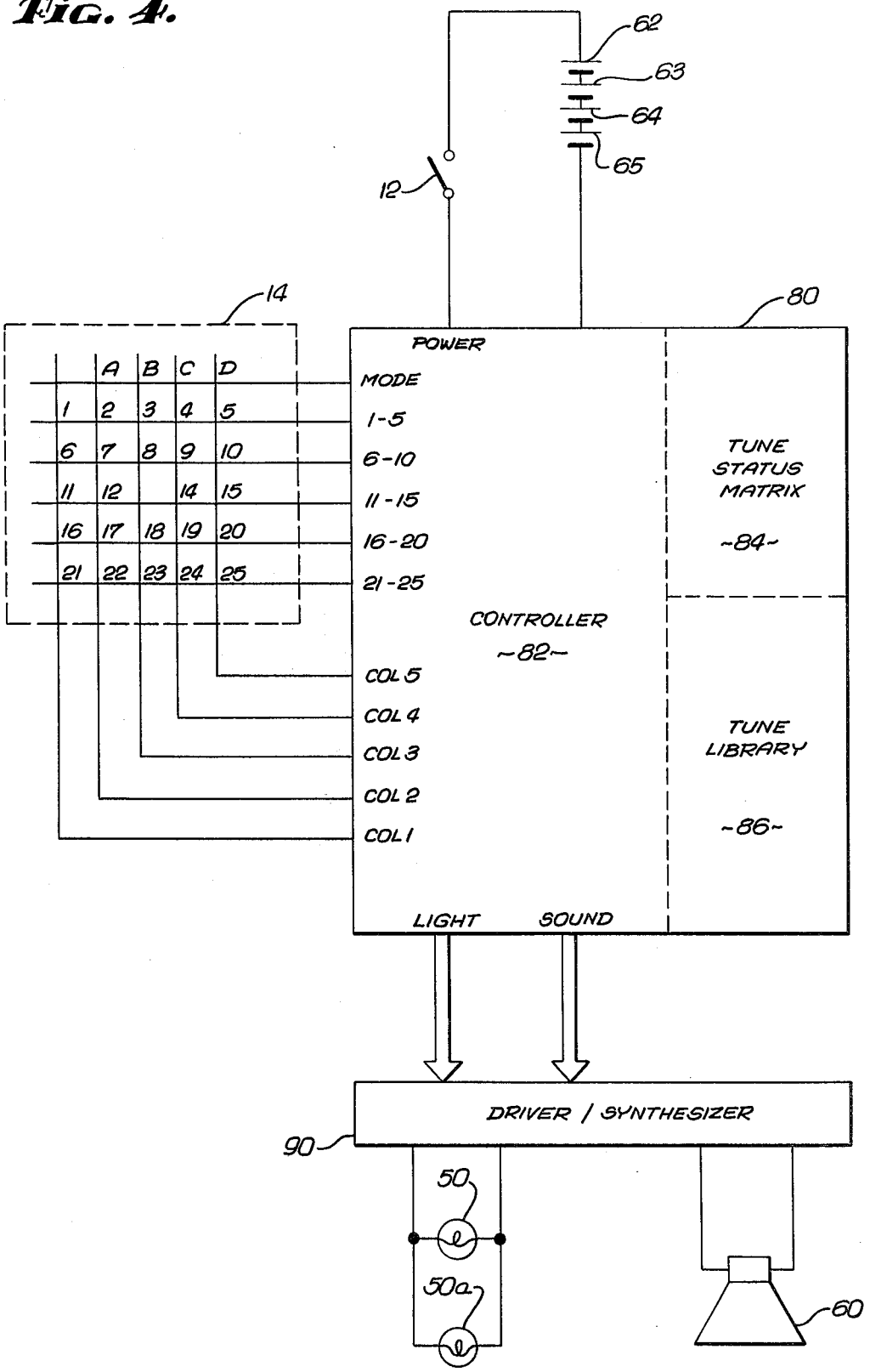
FIG. 4 is a block diagram showing the various electrical and electronic components of the apparatus of FIG. 1 and how they are electrically connected one to another.

Referring now to FIG. 4, showing in block diagram schematic form the various electrical components of the apparatus shown in cross-section in FIG. 2 and in plan view in FIG. 1, it may be seen that batteries 62, 63, 64 and 65 are connected via switch 12 to an electronic circuit designated generally by the reference numeral 80 and comprising a controller portion 82, a tune status matrix 84 (which could take the form of a separate read alterable memory "RAM") and a tune library 86 (which could take the form of a separate read only memory "ROM"). Serving as the control inputs to the circuit arrangement 80 is the keyboard matrix 14 herein shown in a schematic rather than a clearly realistic manner. Suffice it to say that when, for instance, the mode "A" button (see also FIG. 1) is pressed, the input line to circuit 80 labeled "mode" is connected to the input line designated "COL 2"; when designator button "1" is pressed, the input line labeled "1–5" is connected to the input line designated "COL 1". Also shown in FIG. 4 is a driver/synthesizer block 90 connected to the "light" and "sound" outputs of circuit 80 and in turn driving a loudspeaker (shown diagramatically at reference numeral 60) and a pair of light bulbs 50 and 50*a*.

It should be understood, however, that although shown as a separate discrete component, the driver synthesizer function of block 90 of FIG. 4 could, using conventional micro-processor programming techniques, be implemented as just another function performed by controller portion 82 of electronic circuit 80.

Prior to describing in detail the operation of controller 82, with particular reference to the functional flowchart of FIG. 5, an overall description of the apparatus in use will now be given from the perspective of the player.

When the game is turned on by means of switch 12, a scrambling sequence of noises is output by speaker 60 and lights 50 and 50*a* flash on and off, thereby giving the impression of a computerized data processing machine coming to life. This is a signal to the players that the machine is about to scramble (i.e., re-assign) the pre-Programmed tunes amongst the various numbered buttons of the keyboard 14 and is ready for the play to begin. One of the players should then push one of the four mode selector buttons labeled A, B, C, and D and the game (if a game mode is selected) actually commences.

D is the musical instrument mode, that is to say, each of the twenty-four buttons is a separate note in a two octave chromatic scale, and will not be described in detail hereinafter. A, B, and C are all tune matching game modes of varying levels of difficulty, A being the easiest and C being the most difficult.

In mode A, all matched pairs are either "even" or "odd," that is to say, if the first selected button of a possible pair is an odd number (for instance, 1), then the second button of that pair must also be an odd number (in this particular instance, 3, 5, 7, 9, 11, 15, 17, 19, 21, 23, or 25); thus, instead of having up to 23 possible second keys to choose from, the player is confronted with at most 11, thereby slightly approximately doubling his chances of success. To assist players in this mode the "even" and "odd" keys may be of different colors.

In mode B, tunes are scrambled and distributed amongst the buttons in pairs which are not restricted as to being even or odd, thus approximately doubling the difficulty of play, as compared with mode A.

In mode C, the player is permitted to hear only the first few notes of the tune (typically three notes).

If one of the mode selector buttons has not been depressed within 10 seconds after the game is turned on, the constant scrambling noise and flashing lights will stop in order to conserve battery life. However the game continues to await the selection of a mode and even though the lights are extinguished and the speaker is silent, pressing a mode select button will immediately place the game in the selected mode.

The mode (with its attendant level of difficulty) having thus being selected, the game is now ready for actual play and the first turn begins. The player depresses one of the numbered buttons. This causes the electronics to generate and perform the notes of the tune associated with that particular button (and also associated with another button whose designation may not yet be known to the player). Depending upon the level of difficulty selected by the mode switches, either the full time or a portion thereof (approximately 3 or 4 notes) is heard. The player then has a limited period of time (typically seven seconds signalled by the sound of a ticking clock) to find and select the button paired with the selected button; that is to say, the one other button on the keyboard 14 which would have caused the same note sequence to be performed. If from a previous turn of the same game, the player remembers hearing the same sequence of notes when a different button had been pressed, he merely presses that other button and is rewarded with the same tune being played but this time in a full embellished arrangement which is followed by a distinctive "win" sound and the flashing of lights 50 and 50*a*. However, if the player does not known from a previous turn of the same game which other button of the keyboard corresponds to the same tune, he selects a possible candidate button and depresses it. If he is lucky and the second key button selected is the correct one, he hears the matching tune in the embellished arrangement followed by a "win" sound and sees the lights flashing. Otherwise, he merely hears either the whole or a portion of the tune associated with that second button (depending upon the level of difficulty selected). If the player selects during a given turn a button that has already been matched during a previous turn, he is given a short raspberry sound but allowed to continue his turn. However, he cannot exceed the time allotted for selecting a "legal" (not yet matched) second button.

The players continue to play turns as described above, each player keeping track of the number of successful matches he made during a game by means of the manual scoring accumulator buttons 28, 30, etc.

When all the tunes have been matched, the game is over and the original scrambling noise and flashing lights occur as a signal that the game is completed and a new game is ready to commence.

In the embodiment described in detail herein, scoring is done not by the electronic circuitry automatically, but rather is done manually by the players. Accordingly, the players may agree amongst themselves how to keep score and may give each other handicaps or one player may be awarded two points if he successfully matches two buttons to the same tune, while another more experienced player might be given only one point on a successful match.

Furthermore, to enable players of different levels of skill to play competitively with one another, it is possible for a player to change a level of difficulty associated with his particular turn of the game by pressing one of the mode selector buttons A, B, or C immediately prior to pressing any of the numerical keyboard keys and thus starting the clock ticking for a particular turn. Since the tunes have already been scrambled and distributed amongst the various buttons at the beginning of a game, it is not possible to use the mode keys after the game is underway to determine whether the matches will always be even with even and odd with odd, or may be all possible combinations. However, it is possible to cause the game to play only the first few notes of a tune (mode C) after a button has been selected rather than the full tune or vice versa (modes A or B). It is also possible to provide the apparatus of the present invention with a wild key capability, a detailed discussion of which will be deferred until after the description of the flow-chart of FIG. 5.

Figure 5:
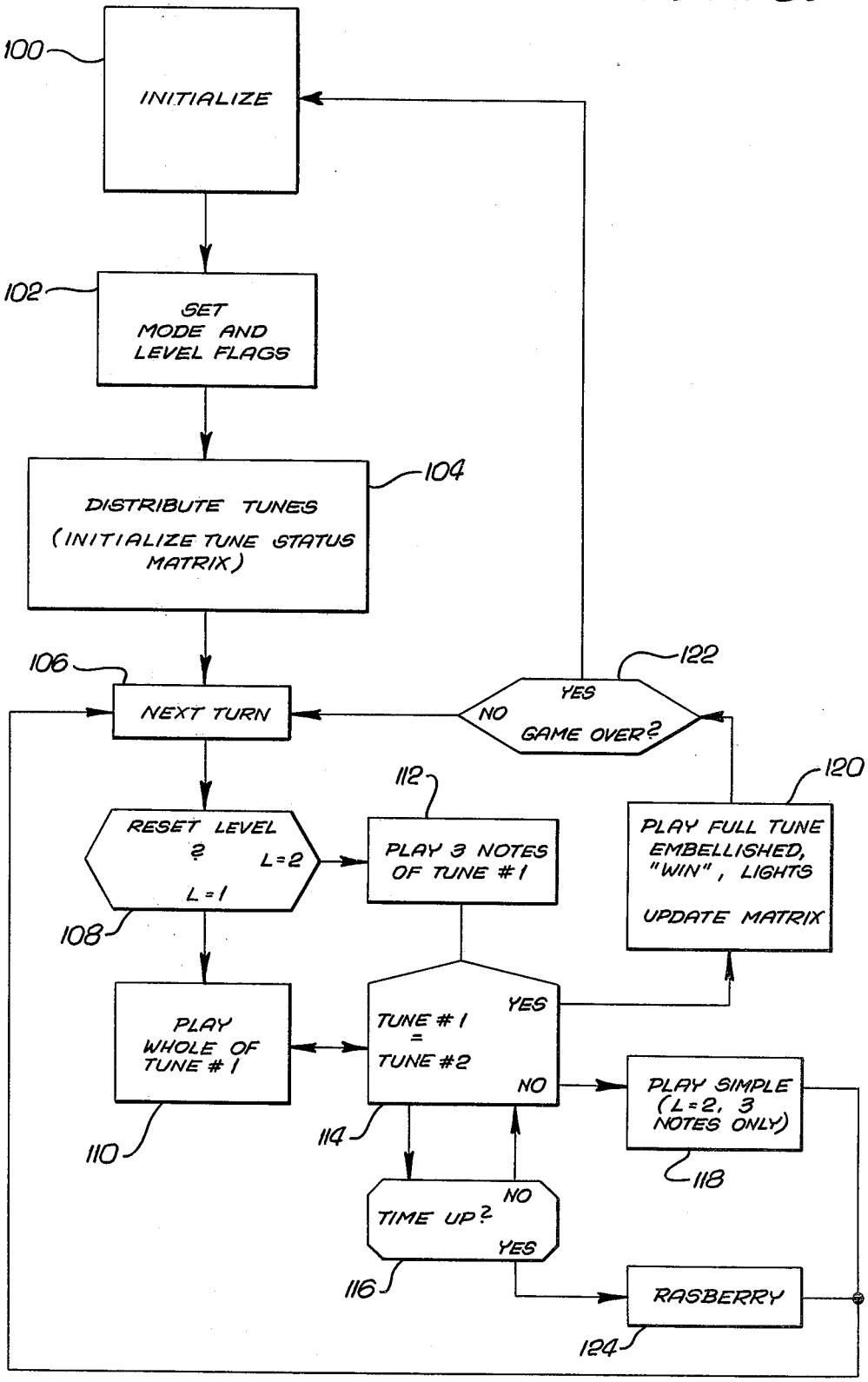
FIG. 5 is a flow chart showing how the controller of FIG. 4 operates from a functional point of view.

Referring now to said FIG. 5 flow-chart, it may be seen that the first function performed by controller 82 during the course of the game is that of "Initialization" as indicated by the block 100. This function is in response to the switching on of power switch 12 and causes the controller and the synthesizer/driver to generate the scrambling sounds and flashing lights signalling the beginning of a game as was described previously. As soon as one of the game mode buttons A, B, or C has been depressed, the controller then sets mode and difficulty flags as indicated in block 102, and then proceeds to distribute or scramble the tunes contained in the library 86 amongst the 24 keys of the keyboard 14 in pairs by means of suitable entries in tune status matrix 84, as indicated by the block 104. As a practical matter, this distribution function is better accomplished after the "mode" has been selected, since the nature of the required distribution is partially affected by whether the odd with odd and even with even restriction associated with mode "A" has been selected.

The various tunes having been distributed amongst pairs of keyboard buttons as symbolized by block 104, the controller now enters the actual start of game play and the first turn is ready to commence as signified by block 106. Although the mode of the game has already been established immediately following initialization, it nevertheless is possible to reset the "Level Difficulty" flag at the commencement of each turn. This function is performed in block 108. As soon as the player has depressed a first tune designator button, the controller, as shown by block 110 causes the tune previously associated by the controller with that first button to be played as shown by block 110, assuming that the "Level of Difficulty" flag has been set to the 1 (or "easy") state. However, if the Level of Difficulty has been set to the 2 (or "difficult") state, the controller causes only the first three notes of the first tune to be played as shown diagramatically by block 112.

For the sake of simplicity, the flow-chart of FIG. 5 does not illustrate the possibility that the player on his first button selector has pressed a button that was part of an already matched pair. However, all that the controller would do in that case is cause a raspberry sound to be output and await the selection of a first tune button by the player that is not already part of an already matched pair.

Having caused either the whole tune or the first three notes of the tune to be played, the controller now awaits to see if the player will select as his second button the other designator of the pair corresponding to the tune that has just been played. This function is shown diagramatically by block 114. The controller at the same time continuously monitors to make sure that the seven seconds (or other pre-determined period of time) within which the player must make his selection of the second tune designator button has not elapsed (a function shown diagramatically by block 116). If the player does not make a correct match, that is to say, the player selects and presses a second button associated with a different tune, that different tune is played either in whole or in part (a function performed by the block 118) and the controller then goes to the Next Turn (block 106). If, on the other hand, the player succeeds in guessing the correct second button of the pair and scores a "match", the controller causes the whole tune to be played in an embellished fashion followed by a "win" sound and flashing lights (shown by block 120) and then (block 122) the controller checks tune status matrix 84 to see if all tunes have been matched, in which case the game is over and control is returned to the initialization function of block 100 the scrambling noises are heard and the lights flash. If, on the other hand, the game is not over and there are still tunes remaining unmatched, the tune just matched and its two associated buttons have been so indicated in the tune status matrix 84 and control is returned to the next turn function of block 106.

The above assumes that the player makes a good or a bad match attempt (second designator selection) within the allocated time. If, however, he does not depress a legal (that is to say, not yet matched) second designator button within the time allocated; the controller 82 causes a raspberry sound to be emitted by loudspeaker 92 (a function shown diagramatically by block 124) and control passes to the "Next Turn" block 106. Again, in the interest of simplicity, it is assumed that the player does not in his match attempt press a button that is already part of a matched pair (not "legal"). However, as is apparent from the operational description above, this does not affect the normal operation of controller 82 and the flow from one functional block to another, but rather, a raspberry sound similar to that generated by block 124 is emitted from loudspeaker 92 and the timing function of block 116 continues until either the time is used up, or else a legal second button has finally been depressed and the match is either good or bad, causing respectively control to pass to function blocks 120 or 118, respectively.

It will be recalled that an optional "wild" key mode of operation has been alluded to previously, but not as yet described in detail. If such an option is provided, then at the time that the various pre-programmed tunes contained in the tune library 86 are assigned to pairs of individual keys of keyboard matrix 14, certain of the keys are designated as "wild." If, on the start of his turn, a player selects not a key associated with a particular unmatched tune, but rather a key that has been designated as "wild" but not yet selected, then the controller 82 causes a "wild key sound" to be heard from loudspeaker 60 and accompanied by the rapid flashing of lights 50 and 50*a*, whereupon control then passes to the matching and timing functions of blocks 114 and 116, with the caveat that in the case of a "wild" selection, the selection of any legal second key button results in a good match. Furthermore, block 120 must update tune status matrix 84 to show not only the tune button selected in operation 114 as matched, but also its corresponding pair mate as well as the wild key selected in the operation of box 110.

If the "wild" key is pressed during the second key select operation of block 114, then again the "wild key sound" is heard and control passed to block 120, with the same caveat as to updating matrix 84.

Although the present invention has been described above with reference to a particular embodiment having four mode keys and twenty-four active tune designator keys, other variations and embodiments will be readily apparent to those skilled in the art without departing from the spirit of the invention.

By way of example and not of limitation, the musical instrument mode may be dispensed not altogether. On the other hand, the musical instrument mode may be retained but only eight designator keys provided. In that latter case, the apparatus will still be able to function as a musical instrument capable of playing the full major musical scale of do, re, mi, fa, sol, la, ti, do. With only eight designator keys, the tune matching musical concentration game of the present invention can still be played, albeit at a much easier level of difficulty.

The scope of protection to be afforded this invention should accordingly be measured only by the claims appended to the patent upon its issuance.

What is claimed is:

1. A musical game apparatus comprising:

a. at least eight different tune select designators that may be manually selected by a player;

b. a mode selector for selecting at least a first mode and a second mode;

c. synthesis means for generating musical notes and making them audible to the player;

d. memory means for storing a plurality of pre-programmed sequences of musical notes;

e. control means operable in said first mode for associating at the start of a game particular ones of said stored sequences each with two of said designators and for causing, during each turn of play within a game, said synthesis means to play a first musical note sequence associated with the designator first selected by the player within said turn of play and then determining whether a second designator also selected within said turn of play is also associated with said first sequence, said control means being operable in said second mode for respectively causing at least eight different single musical notes to be played by said synthesis means upon the respective manual selection of eight different turn select designators, thereby permitting all eight notes in a musical octave to be manually selected and played in any order, said control means randomly operating to assign a "wild" status to one or more of said designators at the start of a game and thereafter treating each such "wild" designator as associated with all of said sequences.

2. A musical game apparatus comprising:

a. at least eight different tune select designators that may be manually selected by a player;

b. a mode selector for selecting at least a first mode and a second mode;

c. synthesis means for generating musical notes and making them audible to the player;

d. memory means for storing a plurality of pre-programmed sequences of musical notes;

e. control means operable in said first mode for associating at the start of a game particular ones of said stored sequences each with two of said designators and for causing, during each turn of play within a game, said synthesis means to play a first musical note sequence associated with the designator first selected by the player within said turn of play and then determining whether a second designator also selected within said turn of play is also associated with said first sequence, said control means being operable in said second mode for respectively causing at least eight different single musical notes to be played by said synthesis means upon the respective manual selection of eight different tune select designators, thereby permitting all eight notes in a musical octave to be manually selected and played in any order, said mode selector being operable to select a third mode having a level of difficulty greater than that of said first mode.

3. The apparatus of claim 2 wherein said control means, upon determining that said second designator was not associated with said first sequence, causes a second musical note sequence associated with said second designator to be played.

4. The apparatus of claim 3 wherein upon reaching the end of a game (i.e., all pairs of designators have been successfully matched to their associated musical note sequences) said control means signals that it is ready to start a new game and to re-associate in a new and different fashion particular ones of said stored sequences each with two of said designators.

5. The apparatus of claim 2 wherein when said control means is operated in said third mode only the first three notes of a musical note sequence are heard.

6. The apparatus of claim 5 wherein said control means may be switched from said first mode to said third mode or vice versa at the start of each turn of play.

7. The apparatus of claim 2 wherein when said control means is operated in said first mode "even" designators always match "even" designators and "odd" designators always match "odd" designators, and when said control means is operated in said third mode, "even" designators may match "even" or "odd" designators, and vice versa.

8. Game apparatus comprising:

a plurality of designators that may be selected by a player;

first means for storing a plurality of pre-programmed tunes;

second means for making the notes of said pre-programmed tunes audible to the player;

third means for re-associating in a new and different fashion at the start of each game at least one of said stored pre-programmed tunes with at least two of said designators;

fourth means for causing said second means to play the notes of the particular tune associated with a particular designator upon the selection of said designator by the player; and fifth means for indicating whether the player has been successful on a particular turn of play within a game by being the first to successively select a particular two of said designators that are associated with the same tune, which successful selection is termed a successful match of associated designators and a "win."

9. The apparatus of claim 8 wherein said apparatus additionally comprises means for determining whether or not a designator selected by a player in a particular turn of play within a game has previously been successfully matched as part of a pair of associated designators within said game.

10. The apparatus of claim 9 additionally comprising manually operable scoring accumulator means for permitting each player to accumulate a tally of the number of matches he has successfully made since the start of play.

11. The apparatus of claim 9 wherein said apparatus additionally comprises means for determining whether the player has selected two not previously successfully matched designators within an allocated time period associated with a single turn of play.

12. The apparatus of claim 8 wherein said fifth means indicates the winning of a particular turn of play by generating and playing an audible "win" sequence of notes.

* * * * *